United States Patent [19]

Miller et al.

[11] 3,948,505

[45] Apr. 6, 1976

[54] DOCUMENT TURN-AROUND SORTER/STACKER

[75] Inventors: Christian Paul Miller, Washington, D.C.; Franklin Penn Burroughs, Sr., Rockville, Md.

[73] Assignee: Control Data Corporation, Minneapolis, Minn.

[22] Filed: Nov. 1, 1974

[21] Appl. No.: 519,972

[52] U.S. Cl. ..... 271/64; 271/65; 271/DIG. 9

[51] Int. Cl.[2] ..... B65H 29/58

[58] Field of Search ..... 271/DIG. 9, 64, 65

[56] References Cited

UNITED STATES PATENTS

| | | | |
|---|---|---|---|
| 700,722 | 5/1902 | Appel | 271/DIG. 9 |
| 815,008 | 3/1906 | Davidson | 271/64 |
| 1,541,651 | 6/1925 | Matlack | 271/DIG. 9 |
| 2,901,246 | 8/1959 | Wagner | 271/65 |
| 3,008,707 | 11/1961 | McGarvey | 271/64 |
| 3,672,765 | 6/1972 | Altmann | 271/DIG. 9 |
| 3,856,295 | 12/1974 | Looney | 271/DIG. 9 |

*Primary Examiner*—Evon C. Blunk
*Assistant Examiner*—Robert Saifer
*Attorney, Agent, or Firm*—William J. McGinnis, Jr.

[57] ABSTRACT

A document turn-around sorter/stacker comprised of a transport pinch drive roller for driving a sheet up an upwardly sloped ramp until it is released, whereafter it slides back until it re-engages the original roller at a different location and is driven over a pivotable curved sort gate onto a preselected stack.

2 Claims, 1 Drawing Figure

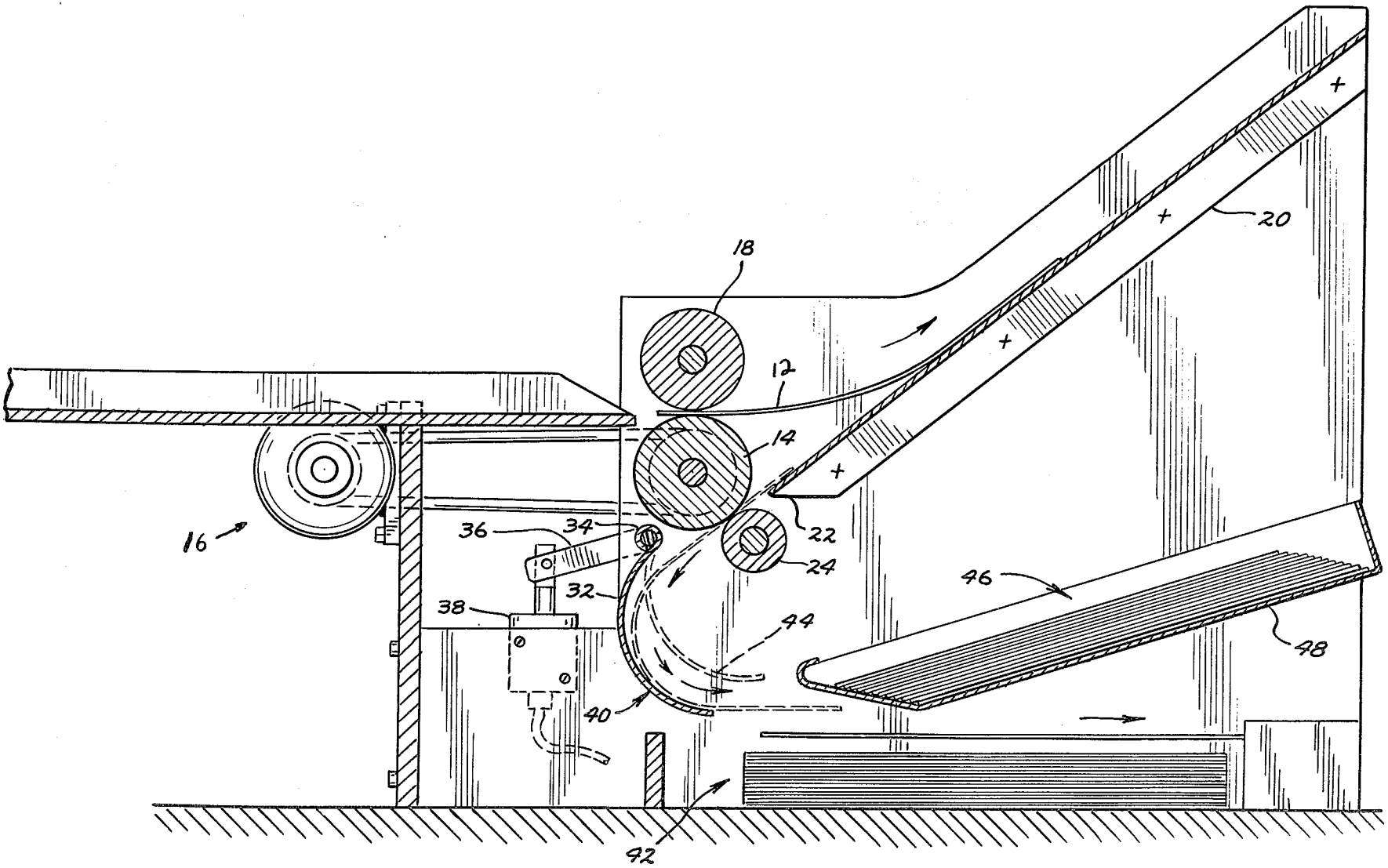
20
48
46
22
24
12
14
18
44
34
32
40
36
38
42
16

DOCUMENT TURN-AROUND SORTER/STACKER

BACKGROUND OF THE INVENTION

This invention relates to a turn-around sorter/stacker which may be used for documents, various papers, data processing cards, or any other thin, flexible item which is to be handled, whether it be of paper, plastic or other material. Primarily, this invention is thought of as a paper handling device to be used at the output of a document reading, printing, duplicating or the like type of device in order to accept the documents after processing and retain them for an operator of the machine.

A primary requirement for any equipment which performs a duplicating, copying, or reading operation on a multi-paged or multi-item document is that the document be returned to the operator of the equipment in the same pagination order as when introduced to the equipment. That is, the operator should not be required to perform or have performed a separate process of reversing the page order of the document. This invention provides a simple apparatus for accomplishing that function. The prior art is replete with document handling devices of a mechanical type which involve complex combinations of levers, rollers and other transport mechanisms to accomplish similar functions.

SUMMARY OF THE INVENTION

A comparatively efficient, non-complex means is provided for receiving a page, turning said page over in a stacking process and also providing for the possibility of sorting into one of at least two possible categories said page during the stacking process.

An individual page enters the stacker by passing over a soft rotating roller operating in a transport pinch drive arrangement and climbs an upwardly, sloped ramp. The trailing edge of the page, when released from the transport pinch drive, and under influence of gravity, slides down the ramp and follows the soft roller around into an idler which further drives the page into a pivotable, curved sort gate. The position of the gate determines whether the page is driven to a first stack or a second stack. The first stack may constitute originals of a document and the second stack may constitute the duplicates thereof. Alternatively, one stack may constitute an "accept" stack and the other may constitute a "rejected" stack for documents in an optical character reader which have been accepted for reading or which have been rejected and must be manually processed.

A page of paper or other thin, flexible material or the like enters the stacker over a soft, rotating roller and climbs a sloped, inclined ramp. The soft, rotating roller may be associated with an idler wheel so that a pinch drive means may be provided in combination with the roller. The trailing edge of the paper, when released from the transport drive, and under influence of gravity, slides down the ramp, follows the soft drive roller around into an idler that pinches and drives the page against the roller into a pivotable curved sort gate. The sort gate may be driven by entirely mechanical means such as levers associated with other parts of the mechanism or simply by a solenoid device between a first and second position or between a first and multiple positions. The ramp and soft roller in combination with the sort gate turn all pages around so that they are in the same order as fed. That is, first in, first out. This is a low-cost, compact and detachable turn-around and stacking method compared to the usual multiple belts and rollers which provide end turn-around and stacking under a main transport mechanism.

The turn-around sorter/stacker of the present invention may be constituted as a detachable device to be used in connection with any device which has as its output a plurality of individual pieces of paper, or the like. For example, it is a requirement in duplicating machines or optical reading machines that the document which may consist of numerous pages be returned to the operator in its original page sequence once it has been processed. Thus, in order to stack pages after processing, it is necessary to turn them around, or they will be in reverse sequence. In addition, if the duplicate copies in a duplicating machine appear sequentially after the originals, it is necessary and desireable to automatically sort the original document from the copy thereof.

IN THE FIGURE

The solitary FIG. 1 is a side cut away view of an embodiment of the present invention.

DESCRIPTION OF THE PREFERRED EMBODIMENT

Referring now to FIG. 1, a form of the present invention is shown constituted as a detachable device which may be affixed to any appropriate machine as desired for the purpose of sorting and stacking pages. A page 12 enters the mechanism from the left-hand side of the FIGURE and encounters a continuously rotating, soft rotating roller 14 driven by a drive means 16, which may be an electric motor acting through belts and pulleys. Also rotating and in contact with the rotating roller 14 is a pinch roller 18 which operates in conjunction with the roller 14 to drive the page from the left-hand side of the FIGURE towards the right-hand side of the FIGURE so that it encounters and climbs an inclined, sloped ramp 20 and rides upwardly thereon until the page becomes disengaged from the pinch roller 18. The roller will be rotated at a comparatively high rate of speed such as, for example, 900 revolutions per minute, so that a large number of documents may be quickly handled. As the pinch roller disengages the bottom edge of the page the soft rotating roller no longer contacts the bottom surface of the page but is engaged with the bottom edge of the page and carries it slightly around and downwardly while the page itself generally remains motionless. The rotating roller 14 is soft rather than a hard rubber or other hard surface so that the bottom edge of the page will remain engaged therewith during this movement. The roller may be made of a soft sponge rubber, a soft rubber or plastic, or may even have a felt or other short bristly surface or any suitable material to engage and carry sheets of material to a position where they slide down ramp 20 under the influence of gravity. The bottom lip 22 is positioned parallel with and adjacent to roller 14 to receive pages as shown in FIG. 1. To some extent, the page is moved rapidly enough and carried rapidly enough by rotating roller 14 so that it is eventually released in a position totally lying on the sloped ramp 20. The ramp 20 is of such a nature that it offers comparatively little friction resistance to a page lying thereon so that when the page is released by the roller 14, it will commence to slide under the influence of gravity to and over a bottom lip 22 and engage once more with the roller 14 and an idler 24 positioned in driving relation therewith.

A curved, generally semi-cylindrical pivotable sort gate 32 is positioned to receive the page after passing through the rotating roller 14 and idler wheel 24. The sort gate is curved to deflect the page in the opposite direction of horizontal mode travel from that in which received and to force it into a stack. The gate is pivotably mounted at point 34 for movement between a first position and at least one other position. Of course, the sort gate may be used in only one position exclusively and may not even be pivotably mounted, but the greatest advantage of the versatility of this invention may be achieved by the pivotable mounting. The moveable gate 32 may be operated in any one of numerous ways, but the mechanism shown here consists of an arm 36 operated by a solenoid 38 between various positions. Shown here, the gate has a first position or lower position shown in solid lines 40 where the pages are directed to an "accept" stack 42. Shown in dotted line position 44, constituting an upper or raised position, pages are directed to a "reject" stack 46 supported by an extended cantilevered tray 48 from the opposite side wall to which the sort gate 32 is mounted. It is to be noted that the "reject" stack or any successive stack into which paper may be sorted must progressively be moved laterally away from the bottom or "accept" stack to account for the transverse movement of the sort gate during pivoting. Of course, the various document stacks may be employed for any of various purposes which need not be detailed here, it being recognized that such a feature is desireable. The solenoid 38 may be controlled by any suitable mechanism depending on the purpose for which used. A manual, operator controlled switch would be an illustrative embodiment, sufficient for the present purpose, whereby an operator selects between spoiled and acceptable copies received from a duplicating machine, or between original and copied documents in a copying machine or between readable and unreadable documents received from an optical page reading machine.

What is claimed is:

1. A document handling device comprising:

an upwardly inclined, sloped ramp having a surface adapted to have a low friction engagement with documents and having a lower lip at the bottom end thereof, drive means for moving documents, said means comprised of a continuously rotating roller over which documents are conveyed at a generally upwardly facing document contact area thereof, to and up said ramp until said documents are momentarily released and disengaged therefrom whereafter said documents slide down said ramp and are further conveyed by said roller, at a generally downwardly facing document contact area thereof, said roller being positioned parallel with and adjacent to the bottom lip of said ramp with the roller having its downwardly facing document contact area positioned with respect to said bottom lip in such a fashion that documents passing over said bottom lip come into contact with said roller at said area, a curved generally semi-cylindrical member, comprising a pivotable curved sort gate movable from a first position to at least one other position, said sort gate having a document contacting face over which documents pass on the inside surface of said sort gate, for receiving documents from said drive means and positioned proximate to said downwardly facing contact area of said roller so that documents delivered by said drive means engage said sort gate and face thereof, said sort gate having sufficient curvature so that the downwardly facing surface of a document passing from said drive means becomes the upwardly facing surface thereof when passing from said curved sort gate, means for moving said sort gate from said first position to at least one other position so that documents received by said sort gate may be directed between a first location and at least one additional location, and means for receiving and accumulating documents delivered by said sort gate.

2. The apparatus of claim 1 and further comprising an idler roller cooperating with said continuously rotating roller at its downwardly facing document contact area to drive documents over the face of said member.

* * * * *